United States Patent [19]

Hildreth

[11] 4,225,048

[45] Sep. 30, 1980

[54] CLOTHESLINES

[76] Inventor: William G. Hildreth, 19 Karaka St., Hamilton, New Zealand

[21] Appl. No.: 968,783

[22] Filed: Dec. 12, 1978

[30] Foreign Application Priority Data

Dec. 12, 1977 [NZ] New Zealand ..... 185938

[51] Int. Cl.[2] ..... A47F 5/04

[52] U.S. Cl. ..... 211/1.3; 211/196

[58] Field of Search ..... 211/1.3, 196, 197, 205

[56] References Cited

U.S. PATENT DOCUMENTS

| | | | |
|---|---|---|---|
| 205,581 | 7/1878 | Scarritt | 211/196 |
| 867,646 | 10/1907 | Ditmanson | 211/197 |
| 2,784,848 | 3/1957 | Senne | 211/1.3 UX |

FOREIGN PATENT DOCUMENTS

| | | | |
|---|---|---|---|
| 145654 | 3/1952 | Australia | 211/196 |

*Primary Examiner*—Roy D. Frazier

*Assistant Examiner*—Robert W. Gibson, Jr.

*Attorney, Agent, or Firm*—Young & Thompson

[57] ABSTRACT

A collapsible clothesline intended to be stored in situ in the ground and to be erected by water pressure. The clothesline comprises a casing intended to be located in a bore in the ground and a stem which is retractible into and extensible from the casing. The stem itself consists of an inner and an outer stem element, with the former being retractible downwardly into and extensible upwardly from the latter. A number of arms, linked by lines for supporting laundry, are pivoted to the other stem element and are connected by ties to the upper end of the inner stem element. When the inner stem element is extended from the outer stem element, with the other stem element already extended from the casing, the ties pull the arms up from a storage position, in which they lie alongside the stem, to a use position, in which they extend radially from the stem. The clothesline is erected by supplying water pressure to the casing interior and collapsed by relieving such pressure.

16 Claims, 2 Drawing Figures

CLOTHESLINES

BACKGROUND OF THE INVENTION

The present invention relates to collapsible clotheslines and has particular reference to a clothesline of the kind having divergent arms extending from a centre support and lines extending between the arms.

Generally, collapsible clotheslines are designed to be removed from the use location when not required or else to be stored above ground at this location in a collapsed or otherwise partially disassembled state. The removal of a clothesline from its use location naturally involves a measure of inconvenience, which frequently results in the clothesline being left in place even when not in use, thus defeating the advantages offered by that type of clothesline, while storage of a collapsed or partially disassembled clothesline above ground has aesthetic disadvantages, particularly if posts or other such supports remain in place. In addition, collapsing and subsequent re-erection of the clothesline is usually carried out manually, which involves extra time and inconvenience, especially for elderly or handicapped persons.

OBJECTS OF THE INVENTION

One object of the present invention is therefore the provision of a closthesline which can be collapsed and stored in situ in the ground, thereby to conserve space and to conceal the clothesline from view.

Another object of the invention is to provide a clothesline of the kind referred to which can be erected by hydraulic pressure, for example mains water pressure, and collapsed by relief of such pressure.

Other objects and advantages of the invention will be apparent from the following description.

SUMMARY OF THE INVENTION

In accordance with a first aspect of the present invention there is provided a collapsible clothesline comprising a casing, a telescopic stem telescopically retractible into and extensible from the casing, the stem comprising an outer stem element and inner stem element which in use is telescopically retractible downwardly into and extensible upwardly from the outer stem element, first sealing means disposed between the casing and outer stem element to hydraulically seal the casing and outer stem element together, second sealing means disposed between the outer and inner stem elements to hydraulically seal the elements together, a plurality of arms carried by the outer stem element and pivotable between a use position in which they extend subtantially radially of the stem and a storage position in which they extend alongside the stem, a plurality of lengths of line interconnecting the arms, and a plurality of support ties so connecting the arms to the inner stem element at its upper end as to cause the arms to pivot from the storage position to the use position on extension of the inner stem element from the outer stem element and to permit the arms to pivot from the use position to the storage position on retraction of the inner stem element into the outer stem element, the casing being provided with inlet and outlet means for admission and exhaust of liquid under pressure and the inner and outer stem elements being provided with means actable on by such liquid under pressure to effect extension of the outer stem element from the casing and the inner stem element from the outer stem element.

A clothesline according to the invention may be constructed as a self-contained unit which can be stored in a collapsed state in the ground completely out of sight except for the top of the clothesline at ground level. By the admission of liquid under pressure, for example water from a mains source, into the casing the outer stem element can be extended from the casing and the inner stem element in turn from the outer stem element, the extension of the inner stem element simultaneously raising the arms to the use position. The inner and outer stem elements can be retracted simply by relief of such pressure, that is by exhausting the liquid from the casing, and the actions of admitting liquid to and exhausting the liquid from the casing can be carried out by the use of such simple controls as conventional taps or other stop cocks.

For preference the stem is rotatable relative to the casing so that the clothesline can be used in the manner of a conventional rotary clothesline.

The first sealing means expediently comprises a seal fitted on the lower end of the outer stem element and serving as the means actable on by liquid under pressure to effect extension of the outer stem element from the casing. The second sealing means may comprise a similar seal fitted on the lower end of the inner stem element. The sealing means and the means actable on by liquid under pressure can, however, be separate components and the sealing means can be arranged in other locations, for example the second sealing means may comprise a seal fitted to the outer element at its upper end.

Expediently, the arms are pivotally mounted on carrier means at the upper end of the outer stem element, the carrier means preferably being detachably mounted on the outer stem element so as to facilitate disassembly for servicing of the clothesline.

The ties, which preferably comprise flexible connections such as cords, ropes, wires or chains, are for preference connected to the arms intermediate the ends thereof and to a cover member at the upper end of the inner stem element, the cover member serving to cover the upper end of the casing in the collapsed state of the clothesline.

According to a second aspect of the invention there is provided a collapsible clothesline in accordance with the first aspect of the invention, the casing of the clothesline being located in a substantially vertical bore in the ground or equivalent support base.

BRIEF DESCRIPTION OF THE DRAWINGS

An embodiment of the invention will now be more particularly described by way of example with reference to the accompanying drawings, in which.

DESCRIPTION OF THE PREFERRED EMBODIMENT

Figure 1:
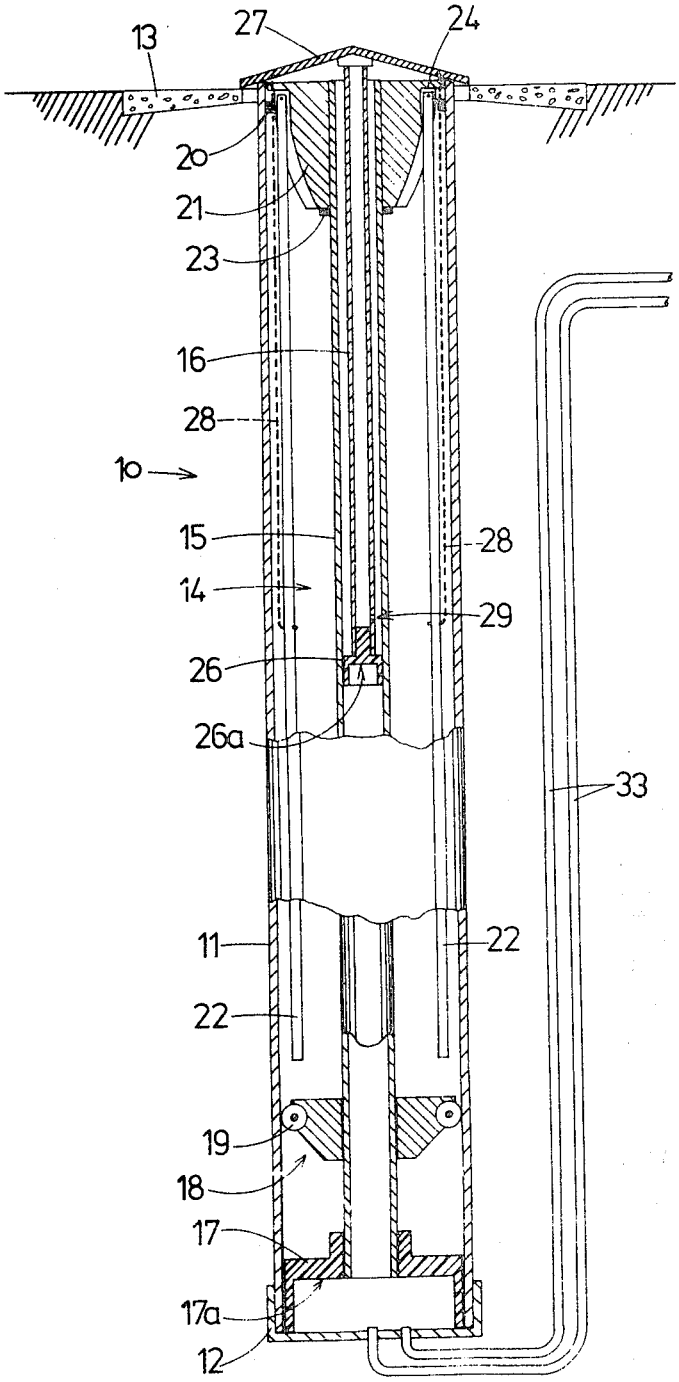
FIG. 1 is a schematic, partly sectioned vertical elevation of a collapsible clothesline according to the said embodiment, the clothesline being in the collapsed state.

Referring now to the drawings, there is shown a collapsible clothesline, indicated generally at 10, comprising a tubular plastics casing 11 located in a substantially vertical bore in the ground. The casing 11 is closed at its lower end by a cap 12 and is open at its upper end, the depth of the bore being such that the open end of the casing is substantially flush with the surface of the ground. A concrete surround 13 may be provided around the open end of the casing.

A telescopic stem indicated generally at 14 is mounted in the casing 11 to be rotatable therein and to be telescopically extensible from and retractible into the casing, the stem consisting of an outer and lower plastics pipe 15 and an inner and upper galvanised iron pipe 16 of somewhat smaller diameter than the pipe 15, the pipe 16 being extensible from and retractible into the pipe 15. As can be seen in FIG. 1, the length of the pipe 15 is almost as great as that of the casing 11 while the length of the pipe 16 is about half that of the pipe 15.

The pipe 15 is provided at its lower end with an annular rubber or plastics seal 17 having a peripheral wall which resiliently bears against the inner wall surface of the casing 11 to effect a hydraulic seal between the casing 11 and pipe 15. Between its peripheral wall the pipe 15, the seal 17 has a generally planar pressure surface 17*a* against which water under pressure acts to raise the stem 14, as will be subsequently explained.

A short distance above the seal 17, the pipe 15 carries a guide 18 equipped with a plurality of wheels 19 running on the inner wall surface of the casing 11. Balls, rollers or other rollable elements may be used in place of the wheels 19. The guide 18 together with the seal 17 centres the pipe 15 in the casing 11 and guides the pipe during its extension from and retraction into the casing. The range of extension of the pipe 15 from the casing 11 is limited by a stop means in the form of an annular abutment 20 arranged at the upper end of the casing to be contacted by and to arrest upward movement of the wheels 19 of the guide 18.

Figure 2:
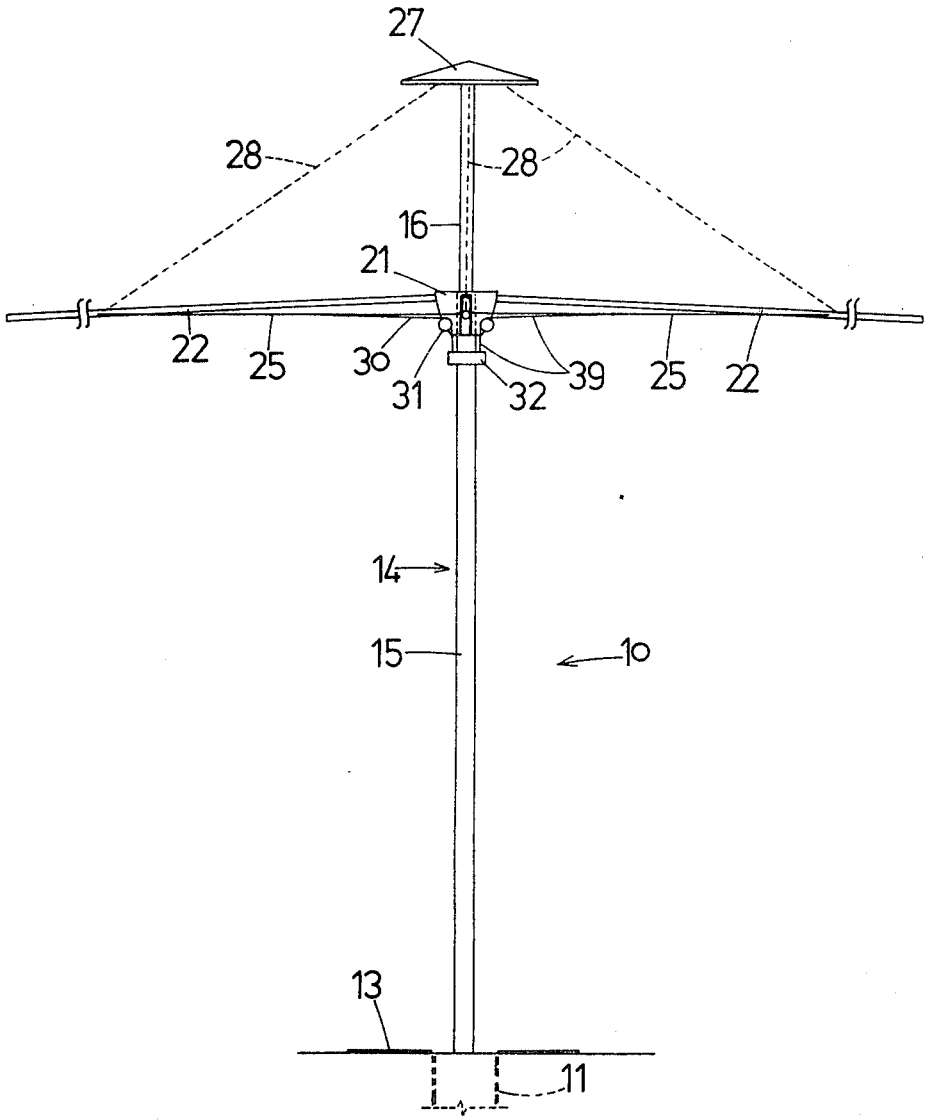
FIG. 2 is a schematic elevation of the clothesline of FIG. 1 in the erected state.

Detachably mounted on the upper end of the pipe 15 is a carrier member 21 provided with four guide channels in which are pivotally mounted four equidistantly spaced metal arms 22, the carrier member 21 being supported on the pipe 15 by means of a collar 23 secured to the pipe. The carrier member 21 is structured so that the arms are pivotable between a storage position in which they extend alongside and thus generally parallel to the pipe 15, as shown in FIG. 1, and a use position in which they extend generally radially of the pipe 15, as shown in FIG. 2. The carrier member 21 includes a peripheral flange portion 24 at its upper end serving as a stop means to limit pivotal movement of the arms beyond the described use position.

The arms 22 are interconnected by lengths of line 25 (shown in FIG. 2 only) which act as supports for laundry or other articles to be aired on the clothesline. For preference, two or more parallel lengths of such line extend between each pair of adjacent arms.

The pipe 16 is similarly provided at its lower end with a rubber or plastics seal 26 which is plugged into the end of the pipe 16 and which has a peripheral wall resiliently bearing against the inner wall surface of the pipe 15 to effect a hydraulic seal between the two pipes 15 and 16. In the area enclosed by its peripheral wall, the seal 26 has a generally planar pressure surface 26*a* against which water under pressure acts to extend the pipe 15 out of the pipe 16, as will be described in more detail later.

Mounted on the upper end of the pipe 16 is a conical metal cover member 27, the diameter of which is greater than the external diameter of the casing 11 and which provides a closure for the upper end of the casing 11 in the collapsed state of the clothesline as shown in FIG. 1. Four ties 28, for example ropes, cords, wires, chains or other flexible or rigid connections, are each attached at one end to the cover member 27 and at the other end to a respective one of the arms 22 at a point approximately midway along the length of that arm. The arrangement is such that with the pipe 15 substantially completely extended from the casing 11, extension of the pipe 16 from the pipe 15 will cause the ties 28 to pivot the arms 22 from the storage position to the use position. The upward travel of the pipe 16 is arrested when the arms 22 contact the flange 24 of the carrier member 21.

At a location just above the seal 26, the pipe 16 is formed with an opening 29 which is arranged so as to be disposed above the upper end of the pipe 15 when the pipe 16 is fully extended and which serves for the reception of a pin or other locking element bearing on the upper end of the pipe 15 to prevent retraction of the pipe 16. By this means, the pipe 16 can be locked to the pipe 15 with the arms 22 raised in the use position.

The clothesline is also equipped with means for gathering in the lengths of line 25 during lowering of the arms 22 to the storage position, and with reference to FIG. 2 such means consists of four cords or wires 30 which are each connected to the lengths of line 25 between a respective pair of the arms 22 and at a point midway between the arms, extend over a respective pulley 31 mounted on the carrier member 21, and are attached to a common annular counterweight 32 slidably engaged on the pipe 15. When the arms 22 are raised to the use position, the splaying of the arms results in the counterweight 32 being drawn up the pipe 15 and, in effect, suspended by the cords or wires 30 from the lengths of line 25 so that the latter are held in tension, and when the arms are lowered to the storage position the counterweight 32 slides down the pipe 15 to pull the lengths of line 25 towards the carrier member 21.

In an alternative arrangement, which is not illustrated in the drawings, the means for gathering in the lengths of line 25 comprises a respective cord or wire connected to the lenghts of line 25 between each pair of adjacent arms at a point midway between the arms, and a coil spring connecting the cord or wire, or the innermost one of the lengths of line 25, to the carrier member 21. The spring is tensioned when the arms are in the use position and relaxed during movement of the arms to the storage position, so as to draw the lengths of line 25 towards the carrier member 21.

Finally, the casing 11 is provided in its base cap 12 with inlet and outlet means for admission and exhaust of water under pressure, the inlet and outlet means being provided by respective openings in the cap 12 through which extend, or with which communicate, a pair of water pipes 33 each incorporating a tap or other stop cock (not shown). One of the water pipes 33, acting as an inlet pipe, is connected to a source of mains water and the other water pipe, acting as an outlet pipe, is arranged to discharge into a drain, gutter or other receptacle or simply onto the ground.

In used of the clothesline 10 hereinbefore described, the clothesline is located in position by insertion of the casing 11 into a suitable bore drilled or dug in the ground at a chosen site, the water pipes 33 are laid in, and the concrete surround 13 is poured or placed around the upper end of the casing 11.

To erect the clothesline, the tap or stop cock in the inlet water pipe is opened to allow water under pressure to flow into the casing 11 and the interior of the pipe 15 below the seal 26. The water pressure acts on the pressure surfaces 17*a* and 26*a* of the seals 17 and 26 to initially extend the pipe 15 out of the casing 11 and then with the arms 22 clear of the casing, to extend the pipe 16 out of the pipe 15. As the pipe 16 is extended out of the pipe 15, the ties 28 act to pull the arms 22 up from the storage position of FIG. 1 to the use position of FIG. 2, the counterweight 32 being drawn up the pipe 15 and acting to tension the lengths of line 25. Once the clothesline is fully erected, the tap or stop cock of the inlet water pipe may be turned off, the tap or stop cock of the outlet water pipe of course remaining closed.

The clothesline is now ready for use in the conventional manner and clothes or other items of laundry can be suspended from the lenghts of line 25, the stem 14 being rotatable in the casing 11 so that the clothesline functions as rotary clothesline.

When it is desired to collapse the clothesline, the tap or stop cock in the outlet water pipe is opened to allow the water to escape from the casing 11 and the interior of the pipe 15, which thus relieves the pressure applied to the pressure surfaces 17*a* and 26*l* of the seals 17 and 26. The construction and arrangement of the clothesline 10 is such that initially the pipe 16 is fully retracted into the pipe 15, with the arms lowering to the storage position under their own weight and the weight of the counterweight 32 gathering in the lengths of line 25, and then the pipe 15 together with the pipe 16 and arms 22 is retracted into the casing 11. When the pipe 15 is fully retracted into the casing, the cover member 27 comes to bear on the concrete surround 13 and thus covers over and conceals the rest of the clothesline.

The tap or stop cock of the outlet water pipe may now be turned off so that the clothesline is in readiness for re-erection.

If it is desired to adjust the height of the fully erected clothesline, a pin or other fastening element can be inserted in the opening 29 in the pipe 16 to lock the pipes 15 and 16 together with the arms in the use position, and a quantity of water can be bled-off by opening the tap or stop cock of the outlet water pipe. This will result in the stem 14 descending in the casing 11 to an extend governed by the amount of water bled-off, thus placing the lengths of line 25 at a lower level to facilitiate the attachment or removal of laundry. The stem 14 can of course be raised back to its fully extended position simply by admitting a replacement quantity of water into the casing 11.

It will be readily apparent that modifications to the clothesline may be made without departing from the scope of the invention as defined in the appended claims, for example different arrangements may be made for the supply and exhaust of water under pressure, including the coupling of a simple garden hose, the seals maya be arranged in different locations, additional seals may be used and the pressure surfaces may be entirely separate from the seals.

The clothesline hereinbefore described is thus convenient and economical to operate, does not require lengthy or awkward assembly and disassembly by hand, and is always available at the use location, yet concealed from view.

I claim:

1. A collapsible clothesline comprising a casing, a telescopic stem telescopically retractible into and extensible from said casing, said stem comprising an outer stem element and inner stem element which in used is telescopically retractible downwardly into and extensible upwardly from said outer stem element, first sealing means disposed between said casing and said outer stem element to hydraulically seal said casing and said outer stem element together, second sealing means disposed between said outer and inner stem elements to hydraulically seal said stem elements together. a plurality of arms carried by said outer stem element and pivotable between a use position in which they extend substantially radially of said stem and a storage position in which they extned alongside said stem, a plurality of lengths of line interconnecting said arms, and a plurality of support ties so connecting said arms to said inner stem element at its upper end as to cause said arms to pivot from the storage position to the use position on extension of said inner stem element from said outer stem element and to permit said arms to pivot from the use position to the storage position on retraction of said inner stem element into said outer stem element, said casing being provided with inlet and outlet means for admission and exhaust of liquid under pressure and said inner and outer stem elements being provided with means actable on by such liquid under pressure to effect extension of said outer stem element from said casing and said inner stem element from said outer stem element.

2. A clothesline according to claim 1, wherein said stem is rotatable relative to said casing.

3. A clothesline according to claim 1, wherein said first sealing means comprises a seal fitted on the lower end of said outer stem element and serving as the means actable on by liquid under pressure to effect extension of said outer stem element from said casing.

4. A clothesline according to claim 1, wherein said second sealing means comprises a seal fitted on the lower end of said inner stem element and serving as the means actable on by liquid under pressure to effect extension of said inner stem element from said outer stem element.

5. A clothesline according to claim 1, wherein said outer stem element is provided with carrier means at its upper end and said arms are pivotally mounted on said carrier means.

6. A clothesline according to claim 5, wherein said carrier means is detachably mounted on said outer stem element.

7. A clothesline according to claim 1, wherein said inner stem element is provided with a cover member at its upper end and said ties are connected to said arms intermediate the ends thereof and to said cover member.

8. A clothesline according to claim 1, wherein said ties are flexible connections.

9. A clothesline according to claim 1, further comprising means for gathering in said lengths of line during retraction of said inner stem element into said outer stem element.

10. A clothesline according to claim 9, wherein said means for gathering in said lengths of line comprises a counterweight slidably engaged on said outer stem element and cords or wires coupled to said lengths of line at points intermediate said arms and to said counterweight.

11. A clothesline according to claim 1, further comprising stop means to limit extension of said outer and inner stem elements from, respectively, said casing and said outer stem element.

12. A clothesline according to claim 1, further comprising guide means to guide said stem during extension from and retraction into said casing.

13. A clothesline according to claim 12, wherein said guide means is mounted on said outer stem element and comprises rollable elements engaging said casing.

14. A clothesline according to claim 1, further comprising means whereby said inner and outer stem elements can be locked together with said arms in the use position.

15. A clothesline according to claim 1, wherein the inlet and outlet means comprises respective openings in the base of the casing.

16. A clothesline according to claim 1, wherein said casing is located in a substantially vertical bore in the ground or equivalent support base.

* * * * *